US005945790A

United States Patent [19]

Schaefer

[11] Patent Number: 5,945,790

[45] Date of Patent: Aug. 31, 1999

[54] SURFACE DISCHARGE LAMP

[76] Inventor: Raymond B. Schaefer, 11 Inverness Rd., Arlington, Mass. 02174

[21] Appl. No.: 08/972,447

[22] Filed: Nov. 17, 1997

[51] Int. Cl.[6] ..... H01J 11/04

[52] U.S. Cl. ..... 315/335; 315/112; 313/484; 313/586; 313/595

[58] Field of Search ..... 315/112, 111.21, 315/335, 326, 248, 261; 313/484, 573, 586, 595, 601, 602

[56] References Cited

U.S. PATENT DOCUMENTS

| | | | |
|---|---|---|---|
| 3,688,151 | 8/1972 | Jansen et al. | 313/348 |
| 3,743,881 | 7/1973 | Blaszuk | 313/217 |
| 3,828,277 | 8/1974 | Otto et al. | 331/94.5 |
| 4,038,577 | 7/1977 | Bode et al. | 313/188 |
| 4,104,693 | 8/1978 | Toda et al. | 361/120 |
| 4,114,113 | 9/1978 | Hasson et al. | 331/94.5 G |
| 4,266,167 | 5/1981 | Proud et al. | 315/248 |
| 4,317,067 | 2/1982 | Fitzsimmons et al. | 315/150 |
| 4,427,921 | 1/1984 | Proud et al. | 315/248 |
| 4,504,147 | 3/1985 | Huang | 356/363 |
| 4,523,846 | 6/1985 | Breckinridge et al. | 356/346 |
| 4,683,379 | 7/1987 | Wolff | 250/493.1 |
| 4,790,642 | 12/1988 | Bruning et al. | 350/574 |
| 4,792,725 | 12/1988 | Levy et al. | 315/39 |
| 4,837,484 | 6/1989 | Eliasson et al. | 313/634 |
| 4,851,734 | 7/1989 | Hamai et al. | 313/485 |
| 4,945,290 | 7/1990 | Eliasson et al. | 315/246 |
| 4,983,881 | 1/1991 | Eliasson et al. | 313/607 |
| 5,006,758 | 4/1991 | Gellert et al. | 313/634 |
| 5,013,924 | 5/1991 | Armstrong et al. | 250/504 R |
| 5,013,959 | 5/1991 | Kogelschatz | 313/36 |
| 5,028,847 | 7/1991 | Greb et al. | 315/248 |
| 5,030,894 | 7/1991 | Yoshiike et al. | 315/335 |
| 5,049,777 | 9/1991 | Mechtersheimer | 313/35 |
| 5,055,748 | 10/1991 | Reinhardt | 315/335 |
| 5,061,876 | 10/1991 | Park | 313/581 |
| 5,065,075 | 11/1991 | Greb | 315/248 |
| 5,235,256 | 8/1993 | Nuckolls | 315/326 |
| 5,420,481 | 5/1995 | McCanney | 315/291 |

FOREIGN PATENT DOCUMENTS

| | | |
|---|---|---|
| 2603995 | 3/1988 | France . |
| 2209210 | 5/1989 | United Kingdom . |

OTHER PUBLICATIONS

Bashkin et al., "High–power 1 μsec ultraviolet radiation source for pumping of gas lasers," Sov. J. Quantum Electron., vol. 6, No. 8, Aug. 1976.

Belousova et al., "Dynamic and visible characteristics of a high–power converging discharge formed by grazing sparks," Sov. Phys. Tech. Phys. 24(8), Aug. 1979.

Beverly et al., "Application of surface discharges for UV photodissociation, photoinitiation and preionization of gas–flow lasers," Inst. Phys. Conf. Ser. No. 72, Paper presented at 5th Symp., Oxford, Aug. 1984.

Andreev et al., "$CO_2$ laser initiated by a gliding discharge," JETP Lett., vol. 21, No. 7, Apr. 1975.

Andreev et al., "Investigation of sliding spark in air," Zhurnal Prikladnoi Mekhaniki i Tekhnicheskoi Fiziki, No. 3, pp. 38–43, May–Jun. 1978.

(List continued on next page.)

*Primary Examiner*—Don Wong
*Assistant Examiner*—Haissa Philogene
*Attorney, Agent, or Firm*—Iandiorio & Teska

[57] ABSTRACT

A high intensity discharge lamp includes a dielectric substrate, a first electrode near the dielectric substrate, a second electrode spaced from the first electrode and near the dielectric substrate, a conductor spaced from the dielectric substrate, and adapted to provide a current return from one of said electrodes to an electrical driver circuit, and at least one metal element near the dielectric substrate. The electrical driver circuit is constructed to produce an electric potential sufficient to cause an electrical breakdown of a medium between the electrodes. The lamp and metal element are also arranged to enable a coolant to flow adjacent to at least one surface of the dielectric substrate to transfer heat from the dielectric substrate to the coolant.

26 Claims, 8 Drawing Sheets

OTHER PUBLICATIONS

Baranov et al., "Use of a discharge over a dielectric surface for preionization in excimer lasers," Sov. J. Quantum Electron. 11(1), Jan. 1981.

Borisov et al., "Pulse–periodic 600–W XeCl laser for industrial applications," Sov. J. Quantum Electron. 21(2), Feb. 1991.

Gross et al., "Investigation of the VUV Radiation Produced by a Sliding Discharge," Report No. SD–TR–86–39 The Aerospace Corporation, El Segundo, CA, pp. 1–24, Jun. 1986.

ILC Technology Technical Bulletin 3, "An Overview of Flashlamps and CW Arc Lamps," ILC Technology, Sunnyvale, CA, pp. 31–35, 1986.

Borisov et al., "Pulsed Periodic Surface Discharge," Kvantovaya Electronika, vol. 10, No. 10, pp. 31–35, Oct. 1983.

Zaroslov et al., "A Moving Discharge in $CO_2$ and Excimer Lasers," translation of Akademiya nauk SSSR. Radiotekhnika i elektronika, vol. 29, No. 7, pp. 1217–1241, 1984.

Zaroslov et al., "Spectrical characteristics of vacuum ultraviolet preionization sources for $CO_2$ lasers," Sov. J. Quantum Electron. 8(6), Jun. 1978.

Zaroslov et al., "Use of a surface discharge for preionization of gases in discharge lasers," Sov. J. Quantum Electron. 8(8), Aug. 1978.

SURFACE DISCHARGE LAMP

BACKGROUND OF THE INVENTION

The present invention relates to a high intensity electromagnetic radiation pulsed lamp and the like.

Pulsed lamps known in the art as flash lamps are important in a wide variety of commercial, military, industrial, academic, medical and environmental applications, including treatment of contaminated water and industrial effluent, laser excitation, paint stripping, curing, photography, decontamination, strobes, beacons, and the like. In commercially available flashlamps, electrical energy provided by a capacitor bank is deposited into a gas disposed between two electrodes enclosed in a transparent envelope, creating an electrical discharge. The electrical discharge produces a plasma that is a source of radiant energy, which ranges from the infrared to the ultraviolet regions of the electromagnetic spectrum. The flashlamp is repetitively pulsed to provide throughput for commercial applications.

Flashlamp geometries are, however, constrained by practical envelope shape considerations. For example, electrical initiation of the discharge favors small envelope diameters.

Also, the optical spectrum of most flashlamps has been limited by the choice of the discharge gas and the electrical power delivery system to the flashlamp.

High intensity UV light from flashlamps is also limited because of the close proximity of the plasma to the envelope material, which causes a reversible time dependent increase in absorption of UV light.

For high power applications, flashlamps are typically cooled by gas or liquid flow over the outside of the envelope. Moreover, flashlamps are typically initiated by a trigger on the outside of the envelope.

The Surface Discharge (SD) lamp is a pulsed lamp that is known in the art but has seen little commercialization. The SD lamp has many of the same generic characteristics of flashlamps but circumvents many of the limitations. In an SD lamp the electrical energy is discharged along the surface of a dielectric so that the light emitting plasma takes on the shape of the underlying dielectric. This has lead to SD lamps with envelopes having large areas and several geometries. Linear, rectangular, annular and cylindrical SD lamps are known in the art.

Many SD lamps are initiated by capacitive coupling from the initiating electrode to a conductor placed in contact with the dielectric. Because of the capacitive coupling, the threshold for plasma breakdown of an SD lamp occurs at a low voltage compared to flashlamps. Furthermore, other SD lamps are known in the art in which a conductor in contact with the dielectric provides a channel for coolant flow and also serves as an electrical conductor.

Some SD lamps known in the art are placed in series and/or employ intermediate electrodes to increase the discharge length. However, the length is limited by the voltage of the electrical driver.

Repetition rates of SD lamps can be faster than flashlamps because the plasma decay time is faster in the presence of the dielectric. Nevertheless, repetition rates have been limited to about 1 Khz.

SUMMARY OF THE INVENTION

In a general aspect of the invention, a high intensity discharge lamp includes a dielectric substrate, a first electrode near the dielectric substrate, a second electrode spaced from the first electrode and near the dielectric substrate, a conductor spaced from the dielectric substrate, and adapted to provide a current return from one of the electrodes to an electrical driver circuit, and at least one metal element near the dielectric substrate. The electrical driver circuit is constructed to produce an electric potential sufficient to cause an electrical breakdown of a medium between the electrodes so that a discharge is produced. The lamp and metal element are also arranged to enable a coolant to flow adjacent to at least one surface of the dielectric substrate to transfer heat from the dielectric substrate to the coolant.

Embodiments of this aspect of the invention may include one or more of the following features. The lamp may include a transparent envelope spaced from the dielectric substrate. The metal element can be wire mesh or wire coil. The lamp may include a reflective surface adjacent to one surface of the dielectric substrate. The reflective surface is adapted to provide directionality to radiation emitted from the discharge. The dielectric substrate may include material including at least silicon. To maintain a high emission of UV light, the envelope may be positioned at a specified distance from the location of the discharge.

The metal element may be a trigger element connected to a trigger circuit constructed to produce an electric potential between the trigger element and one of the electrodes to cause the electrical breakdown of the medium, initiated by the trigger element so that the discharge is produced. The lamp may include a multiplicity of trigger elements. The trigger elements may be configured to guide the discharge along the length of the dielectric substrate.

The lamp may be adapted to produce a multiplicity of discharges at a specified production rate. The rate may be at least about 1 Khz. To produce the discharges at such a rate, the electrical driver circuit may include an igniter switch to enable the lamp to operate at a low voltage.

The dielectric substrate may have a generally hemispherical shape with a convex surface and a concave surface. The discharge may occur over the convex surface of the dielectric substrate and the coolant may flow over the concave surface. Or the discharge may occur over the concave surface of the dielectric substrate and the coolant may flow over the convex surface.

The dielectric substrate can be configured as a sandwich structure so that the discharge is produced simultaneously on opposite sides of the dielectric substrate. The sandwich structure may have a planar shape. The structure may include coolant channels through which the coolant flows.

The sandwich structure may have a cylindrical shape or may be shaped as a truncated cone. The sandwich structure may also have an annular shape.

It is advantageous to provide both the cooling of the lamp and initiation of the discharge from inside the closed dielectric surface of a surface discharge lamp. And it is particularly advantageous to provide direct contact between the coolant and the dielectric with a metal trigger element also in contact with the dielectric material and have a separate channel for conducting electrical current.

In some applications, it is advantageous to increase the UV output of SD lamps for paint stripping, surface cleaning, UV curing and the destruction of organic contaminants, for example.

In certain applications it is advantageous to increase the light output in a given spectral range. To achieve this, provision is made for material, for instance, from the dielectric to evolve into the plasma and contribute significantly to the spectrum of the light output. Thus a spectral region is enhanced through the use of the appropriate dielectric material, for example, material made with at least some silicon.

For certain practical high energy operations, it is advantageous for the SD lamp to have a large diameter and a sufficient amount of space separating the envelope from the plasma.

In another aspect of the invention, a high intensity discharge lamp includes a transparent envelope separated by a predetermined distance from the plasma produced by the discharge, so as to increase the lamp lifetime and maintain high UV transmission through the lamp envelope. The distance of the separation depends on the energy and length of the electrical pulse and on the envelope material. In many instances, the desired effect is achieved by arranging the envelope to be three or more centimeters from the plasma.

For some processes, such as treating contaminated water and paint stripping, it is desirable to shape the light emitting plasma into various geometries.

In another aspect of the invention, a high intensity discharge lamp includes a dielectric substrate configured as a hemispheric dome. The discharge is produced on either the concave or convex surface of the substrate. Concave geometries are advantageous for operation in the walls of processing tanks. Convex geometries serve to provide directionality to the light emission. The hemispheric dome geometry also provides easy access for cooling during high power operation.

In yet another aspect of the invention, the high intensity discharge lamp includes a dielectric substrate having a sandwich structure. The discharge is produced on both of the opposed sides of the dielectric substrate. The sandwich geometry provides a compact arrangement that is beneficial for various processes.

In another aspect of the invention, a method to produce a high intensity emission of radiation includes creating an electrical discharge over a dielectric substrate, and cooling the dielectric substrate by directing coolant flow such that the coolant flow is in direct contact with at least one surface of the dielectric substrate.

Other features and advantages will be apparent from the description and from the claims.

DESCRIPTION OF THE PREFERRED EMBODIMENTS

In a surface discharge (SD) lamp, a surface discharge is created by applying an electric potential that has sufficient magnitude to cause electronic breakdown of a discharge gas between two spaced apart electrodes near a dielectric surface. The resulting electronic discharge creates plasma streamers which emit intense incoherent light.

In many commercial applications, the SD lamps would be repetitively pulsed at rates requiring very high power so that the SD lamp requires cooling. The current invention provides a particularly advantageous system of cooling surface discharge lamps from within the lamps.

Figure 1A:
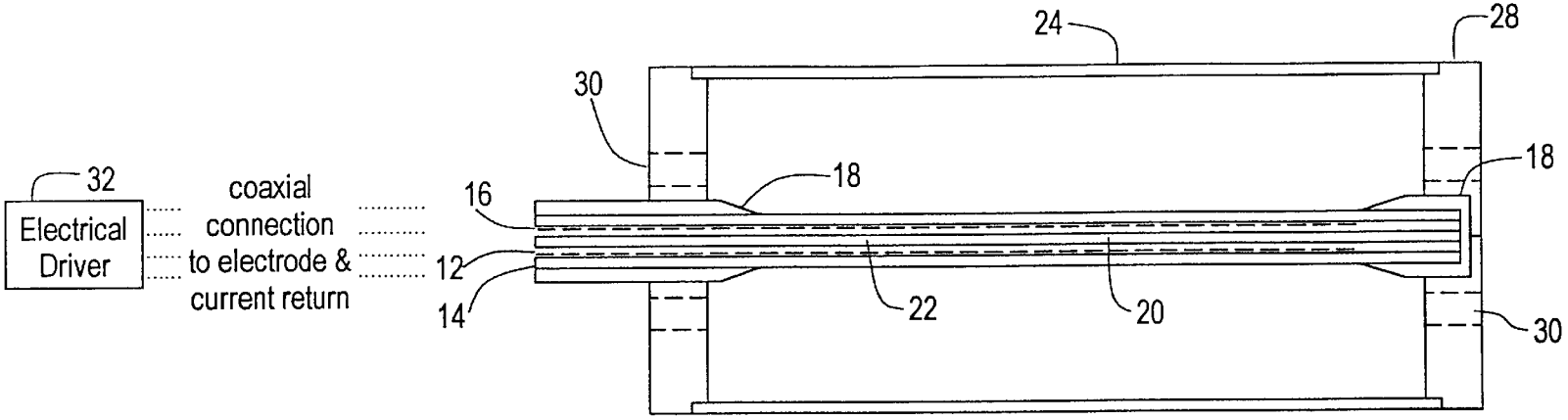
FIG. 1A is a cross sectional view of a surface discharge lamp with an internal trigger element separate from the main current return.
Figure 1B:
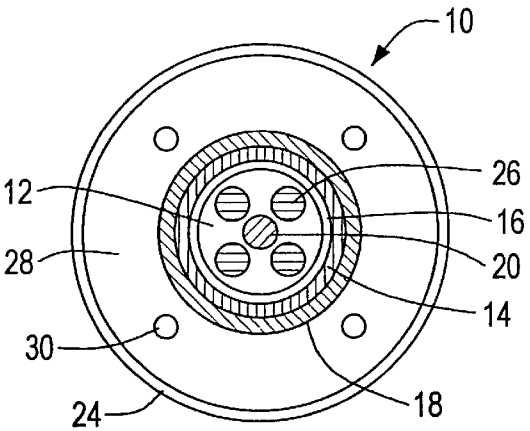
FIG. 1B is an end view of the embodiment shown in FIG. 1A.

Shown in FIGS. 1A and 1B is a surface discharge lamp with a generic electrical driver 32 that typically is one of many capacitor bank or pulse forming networks known in the art. The electrical driver may have a peaking capacitor in some implementations. It increases the voltage across the main electrodes by up to a factor of two over the charging voltage of the main discharge capacitor, and is similar to peaking capacitors in the art. A peaking capacitor allows reduction in the charging voltage of the electrical driver 32.

The SD lamp has a cooling channel 12 inside a cylindrical dielectric substrate 14 with a metal element 16, for example, a coil or mesh, in contact with the dielectric. The open area of element 16 allows the coolant to come in direct contact with the dielectric substrate, which enhances removal of heat. It also minimizes the thermal expansion mismatch between the dielectric and cylindrical current return in SD lamps known in the art. Coil or mesh 16 provides the capacitive coupling with the electrode 18 for initiation, and, in some instances provides an electrical trigger pulse applied underneath the dielectric to initiate the SD lamp. In FIGS. 1A and 1B the electrical current 20 returns through a wire 22 down the center of the cylinder. This arrangement provides efficient cooling and separates the current flow (and consequent heating) from the dielectric. In the cylindrical embodiment in FIGS. 1A and 1B coolant channel ports 26 through the right end cap 28 and electrodes provide the means for coolant flow. The arrangement uses capacitive coupling for initiation and, in some applications, an external trigger pulse. This invention is intended to include applying the inventive cooling and initiating process to all standard SD geometries known in the art, in addition to the novel geometries of this invention to be described below.

When ultraviolet light is desired from SD lamps, the dielectric is a silicon bearing material. The silicon will enhance UV output if the electrical power per area (i.e., intensity) of dielectric is strong enough to vaporize the silicon. Then silicon atoms evolve into the plasma and their preponderance of UV atomic transitions contribute to the light emanating from the plasma. The required electrical intensity depends on the material and the temporal pulse shape, but in many cases is in the neighborhood of one megawatt per square centimeter. Furthermore, if the UV light from the SD lamp transmits through a window 24, then a feature of this invention is that when the window is composed of fused silica or other silica based material, it be located away from the SD. Such a placement prevents or mitigates a time dependent increase in UV absorption that would otherwise occur.

SD lamp pulses can be shorter and more energetic than flashlamps, since the surface discharge is initiated from within (i.e., from under the dielectric) so that the volume available to the gas discharge may be large. This reduces the magnitude of the pressure pulse that impinges on the envelope 24. The window separation from the dielectric substrate results in long lifetime for high intensity and large energy operation. In the cylindrical embodiment in FIGS. 1A and 1B the volume is determined by the diameter of the envelope 24 and end caps 28. Means for gas flow is provided by the gas flow ports 30. The gas is filtered, especially when dielectric vaporization is used to enhance the spectrum. Also, the end cap 28 design is generic, with many versions known in the art included in the invention.

In order to achieve particularly long SD lamps, an external trigger pulse is used in conjunction with one or more trigger elements. The trigger pulse raises the voltage so that electronic breakdown of the gas commences and the trigger element guides the discharge along the dielectric substrate. The length of the discharge is extended through the use of multiple trigger elements in series.

Figure 2:
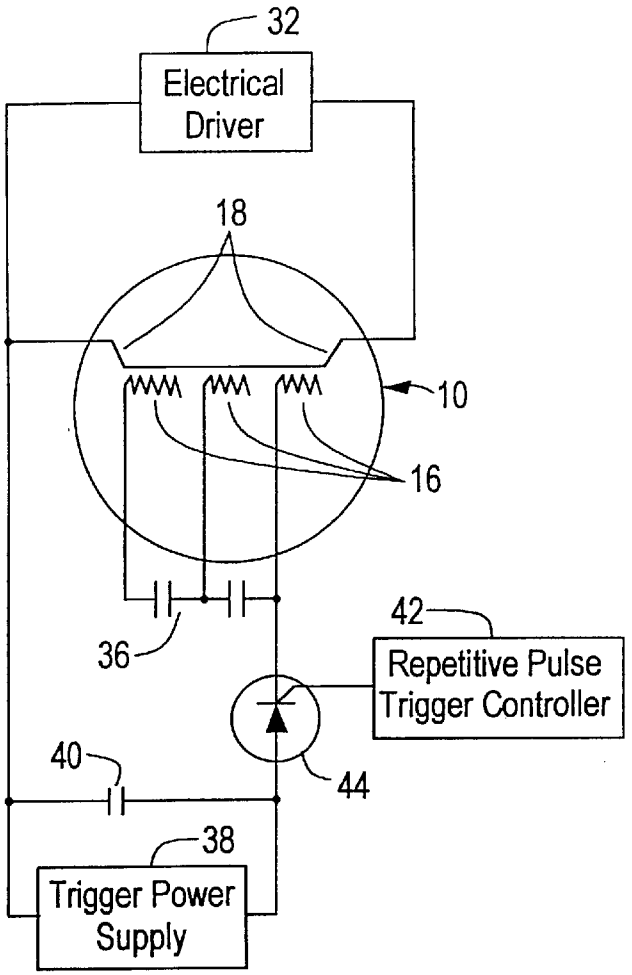
FIG. 2 is a schematic illustration of a circuit diagram for a surface discharge lamp element with multiple trigger elements.

Referring to FIG. 2, a single trigger pulse 42 feeding three metal elements 16 (wires or meshes) is shown. The metal elements 16 serve as trigger elements. In some representations it is advantageous to sequence the pulses to the trigger elements, either by adding delays to each trigger line or using separate triggers for each trigger line. The timing capacitors 36 in FIG. 2 represent the delay function. The number of trigger elements 16 depends on the desired discharge length, along with the circuit parameters of the electrical driver 32 and the geometrical configuration of the SD. The inventive long SD is intended to include, in addition to the novel geometries of this patent, common SD geometries known in the art such as planar, cylindrical and annular.

The trigger circuit in FIG. 2 is a schematic representation. A trigger power supply 38 charges up a trigger capacitor 40. The repetitive pulse trigger controller sends a signal to the trigger switch 44 which completes the circuit with the timing capacitors 36 and trigger elements 16. Any trigger circuit design, e.g., as used for commercial flashlamps, may be employed. The use of a trigger pulse: 1. eliminates the need for a separate main discharge switch (although the invention includes the use of a main discharge switch) and 2. allows the use of relatively low voltage electrical driver 32, which is advantageous in many practical implementations.

The invention also includes the use of an igniter to obtain very high repetition rates. In SD lamps known in the art, the surface discharge plasma dissipates between pulses. The recovery time of the surface discharge plasma between pulses depends on many factors but typically allows for repetition rates of a couple of Khz. The current invention is concerned with repetitively pulsing before the plasma recovers. In this case, the capacitor charging voltage can be considerably less than if the plasma dissipates.

Figure 3:
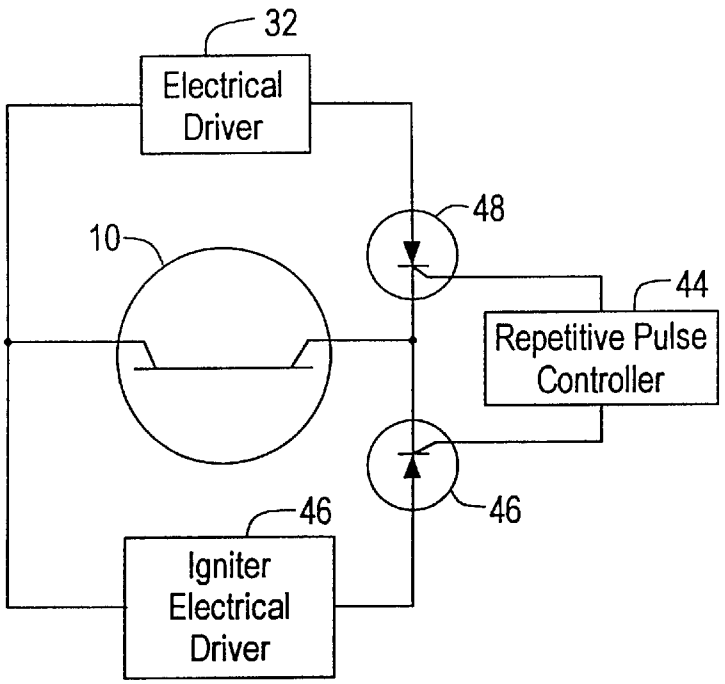
FIG. 3 is a schematic illustration of a circuit diagram for a high repetition rate surface discharge lamp.

Referring to FIG. 3, an igniter electrical driver 46 operates at lamp start-up to establish the plasma. Subsequently the main discharge capacitors are repetitively pulsed at a high rate so that the plasma does not have time to dissipate. The repetitive pulse controller 44 sends trigger pulses first to the igniter switch to establish the SD plasma and subsequently sends trigger pulses to the main switch 48 that results in the electrical driver discharging electrical energy into the plasma in the SD lamp resulting from the previous pulse. The use of the igniter allows the electrical driver 32 to operate at relatively low voltage. The low voltage both matches electrically better to the SD plasma as well as reduces processing cost. The circuit in FIG. 3 does not show electrical isolation between the igniter and main switches, which would be included using methods known in the art.

The electrical circuit parameters are matched to the resistance of the plasma at the desired repetition rate. At repetition rates slower than the recovery time, a similar effect is achieved by employing simmer or pseudo-simmer circuits known in the art, for example, for flashlamps. Some such representations can eliminate the main switch. Instead, trigger pulses would apply directly to a trigger mesh or current return (see FIG. 2).

The invention also includes an alternative means for obtaining very high repetition rates with low energy per pulse. In this case the SD lamp and electrical driver function so that the electrical discharge is incomplete. That is, plasma breakdown does not occur. The plasma streamer propagates across the dielectric substrate but stops short of the other main electrode. The electrical driver 32 is similar to the representation in FIG. 3 but with the igniter circuit removed. The recovery time of incomplete SD's depends on many factors but typically its speed would allow repetition rates up to on the order of ten Khz. Because the electrical current of incomplete SD's is relatively small, the pulse energy is small, which is desirable for some applications.

A variety of geometrical arrangements of dielectric surfaces are understood to be within the scope of the invention, but particularly advantageous arrangements and systems are illustrated in FIGS. 4–10.

Also, electrical drivers are understood to be either of the representations in FIG. 4 or FIG. 5, or other circuits known in the art, such as those used for flashlamps.

Hemispherical Dome Structures

Figure 4A:
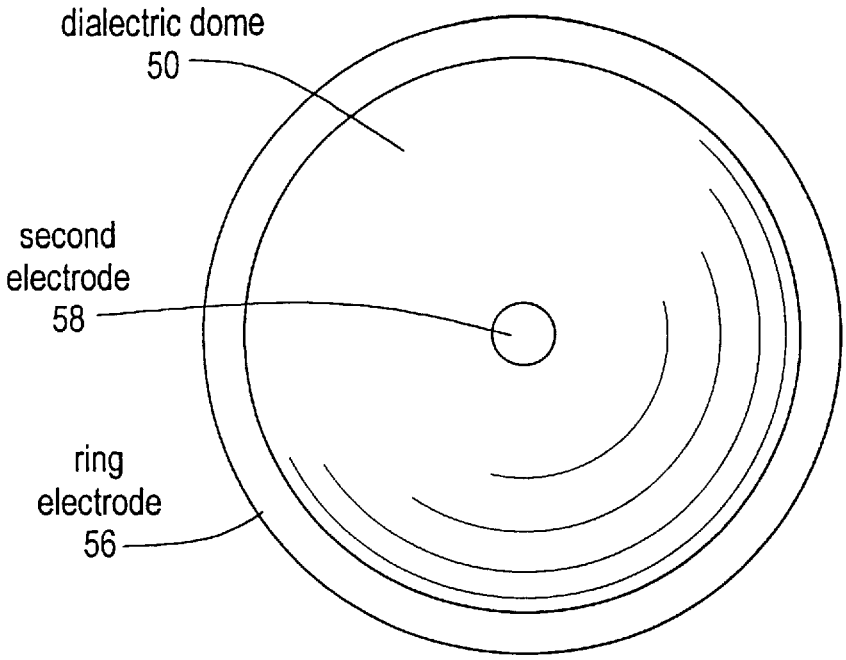
FIGS. 4A and 4B are respective top view and cross sectional view of a hemispherical dome surface discharge lamp with the discharge occurring on the convex side of the dome.
Figure 4B:
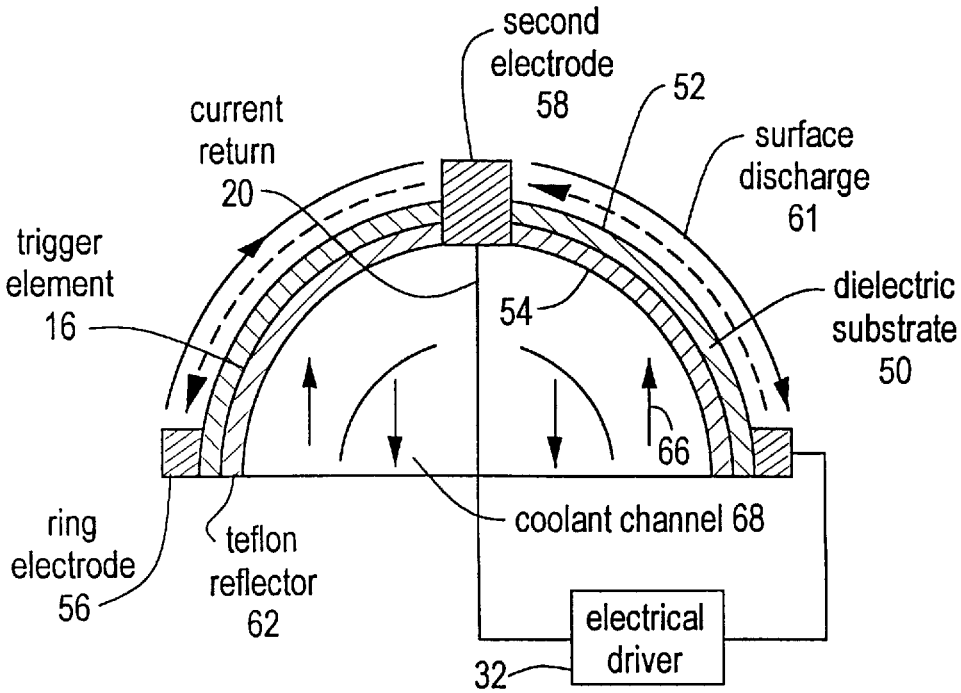

Shown in FIGS. 4A and 4B is a hemispherical dome structure that generates a surface discharge of approximately hemispherical shape on a surface of a dielectric rounded dome 50 that defines convex 52 and concave 54 surfaces. A first ring electrode 56 is mounted near the base of the dome and a second ring or cylindrical electrode 58 is mounted at the top of the dielectric dome. First and second electrodes 56 and 58 are connected to an electrical driver 32 by feed and current return 20 wires, respectively. Non-spherical curved shapes are understood to be included in the invention.

Referring to FIG. 4B, the discharge 61 occurs along the convex surface 52. Ring electrode 56 surrounds the base portion of the convex surface 52 of the dome. A reflective layer formed from, e.g., teflon, lines the concave surface of dome 62 and reflects light that passes through the dielectric material back toward the convex surface. Other reflective surfaces are also contemplated; however, we understand that if an electrically conductive reflective layer is selected, this layer will contact one or neither of the electrodes. Trigger elements 16 extending from the periphery of the dielectric surface to the center of the hemispherical dome are disposed inside the dielectric material of the dome (alternatively, the trigger elements are positioned along the concave surface of the dome) to capacitively guide surface discharge 61 along preselected paths over the convex surface of the dome. For this purpose trigger elements 16 may either be floating (that is, not connected to either electrode) or connected to the ground electrode. The device in certain embodiments is cooled by flowing a coolant 66 through channel 68 over the open concave surface of the dome. For particularly long separation between the first and second electrodes, multiple trigger elements may be employed, as discussed above in regard to FIGS. 1 and 2. Also, it is to be understood that for all the surface discharge geometries shown in FIGS. 4 through 10, that an envelope in certain embodiments is disposed to enclose the lamp and provide a window to transmit the light into the adjacent volume. This arrangement is explicit in FIGS. 1A and 1B, 8A and 8B, and 9A–C.

The structure shown in FIGS. 4A and 4B produces a uniform hemispherical radiation pattern that is useful for efficient dispersal of radiation from a wall of a processing chamber through a relatively large volume of gas or liquid to be treated.

Figure 5A:
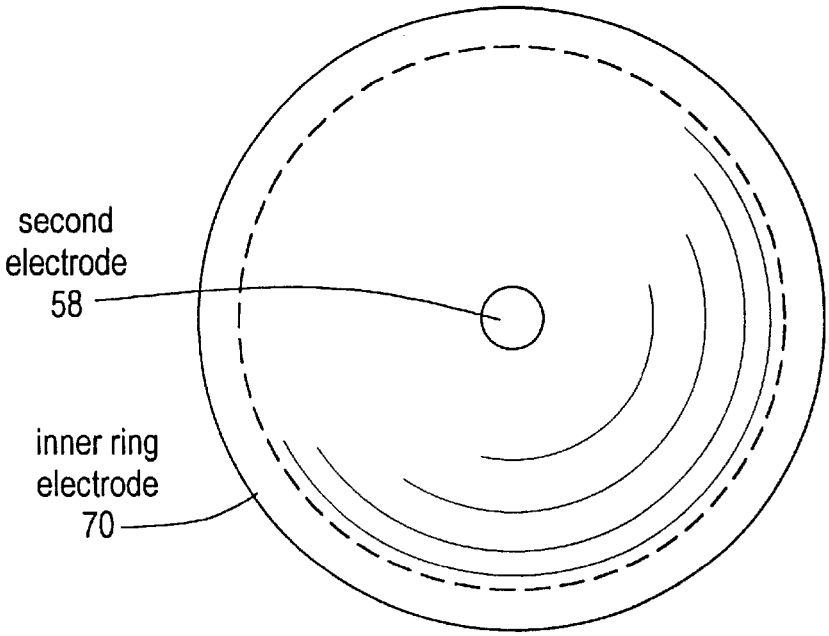
FIGS. 5A and 5B are respective top view and cross sectional view of a hemispherical dome surface discharge lamp with the discharge occurring on the concave side of the dome.
Figure 5B:
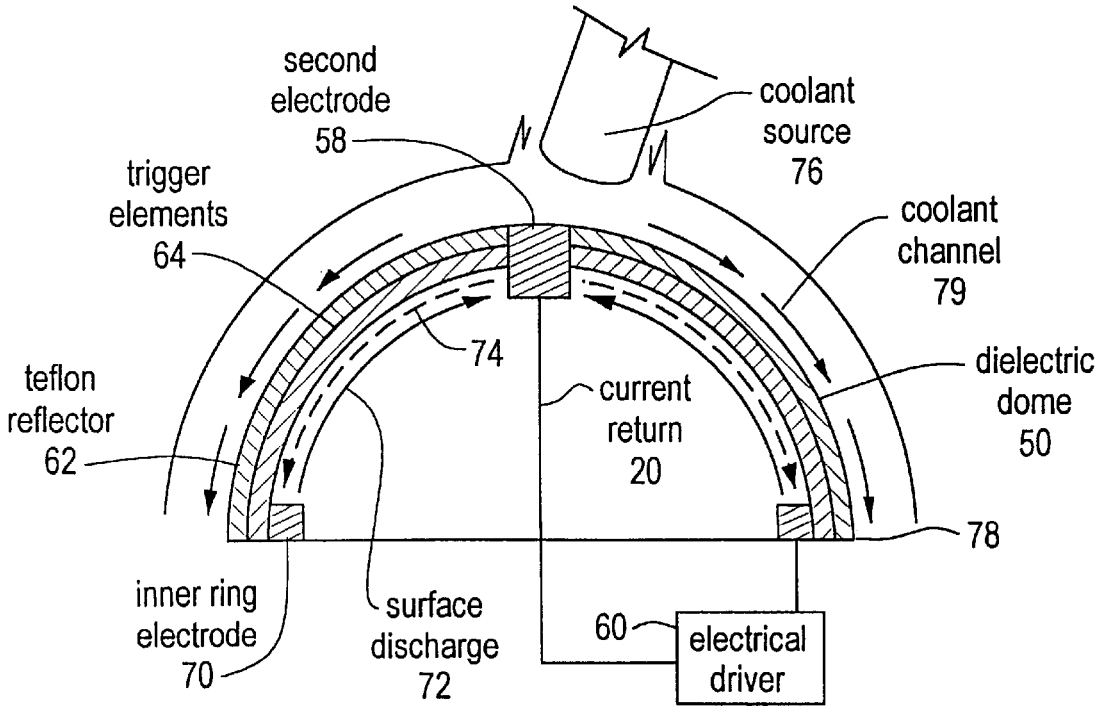

Shown in FIGS. 5A and 5B is another dome embodiment in which discharge 72 occurs along the concave surface. As shown in FIGS. 5A and 5B, a ring electrode 70 is mounted on the concave surface of the dome to produce a discharge along an inner dielectric dome surface 74. The device is cooled by flowing a coolant 76 over the convex surface 78 of the dome. This geometry provides desired collimation of the light or sound generated during a discharge to direct a concentration of light or sound to a desired region.

Sandwich Structures

The term sandwich refers to the common feature of the following embodiments in which surface discharges are generated simultaneously on opposite sides of these radiation sources. The following embodiments represent general structures that may have fewer features than those described in FIG. 6, or additional features as described in regard to FIGS. 1–3, depending upon the desired application.

Planar Embodiments

Figure 6:
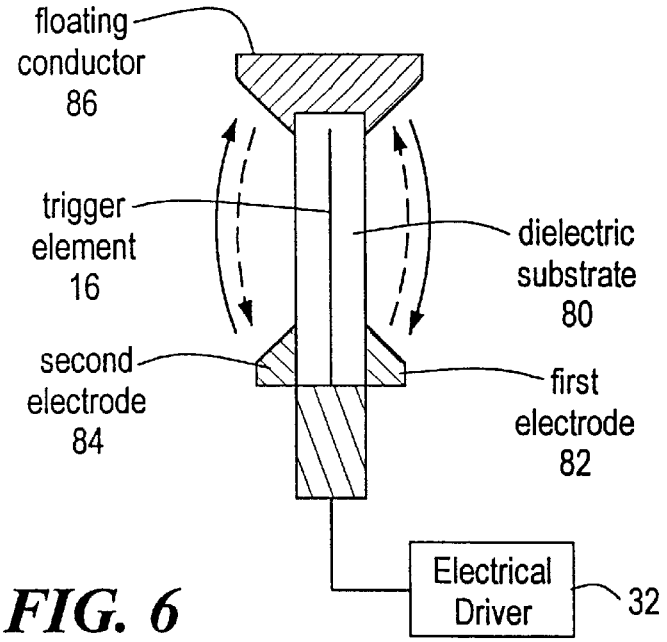
FIG. 6 is a cross sectional view of a planar sandwich surface discharge lamp.

As shown in FIG. 6, a sandwich SD lamp includes a planar dielectric substrate 80, e.g., of rectangular form, first 82 and second 84 electrodes mounted on opposite faces at one end of the substrate, and a floating conductor 86 mounted at the opposite end of the dielectric for providing a conducting path between the opposite faces of the dielectric. The first and second electrodes are connected to a discharge circuit by feed and return wires, respectively. The supply current from electrical driver 32 for generating the surface discharge enters the radiation source through one of the electrodes and leaves through the other electrode. A trigger element 16 is disposed inside the dielectric, extending generally from the region of first 82 and second 84 electrodes to the region of the floating conductor 86, to capacitively guide the surface discharge along a predetermined path over both faces of the dielectric.

Figure 7:
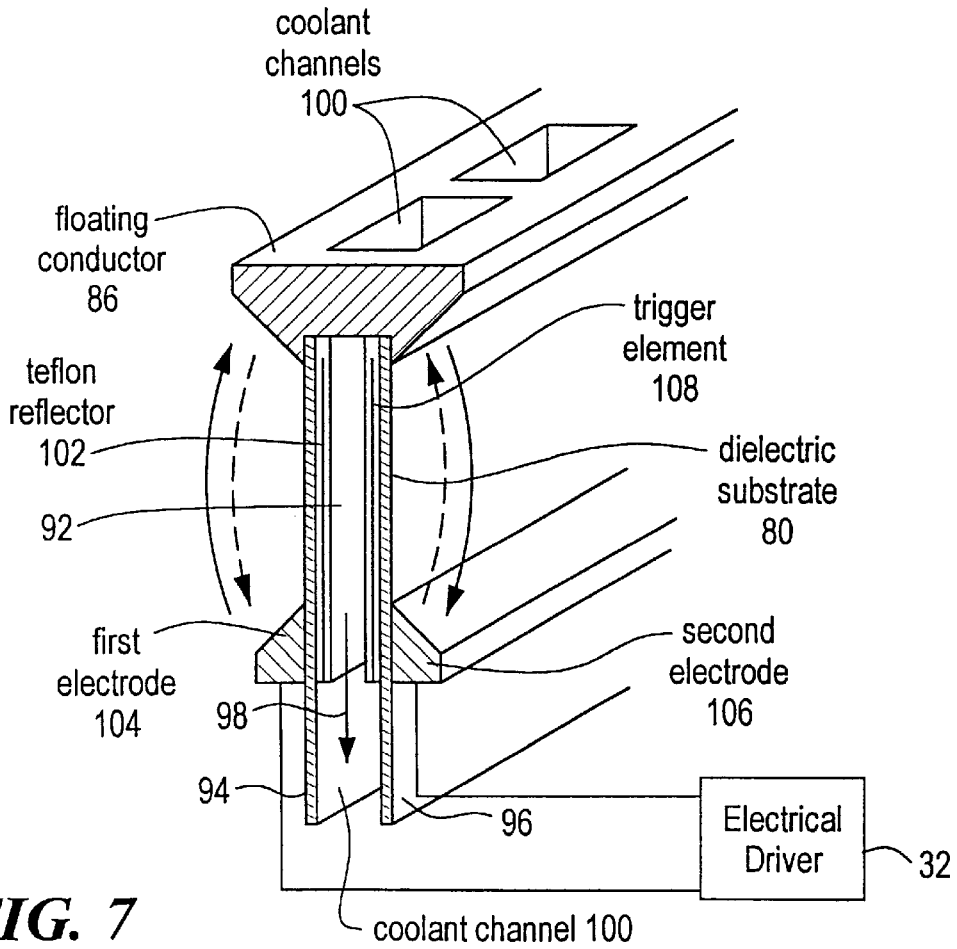
FIG. 7 is a cross sectional side view of a slotted planar sandwich surface discharge lamp with coolant channels.

Shown in FIG. 7 is a slot-form chamber 92 formed between two rectangular dielectric plates 94 and 96. The lamp is cooled by flowing coolant 98 along a channel 100 disposed between the two plates. The flow path is through the lamp, out channels in the floating conductor 86, or by means of a flow in and out with a divider in the middle of the coolant channel. The geometries discussed below may have a like arrangement, which is assumed to be included in this invention. The inner surfaces of the dielectric plates are lined with, e.g., teflon 102 to reflect incoming light back toward the outside of the lamp. Other elements shown are identical to those shown in FIG. 6.

Cylindrical Embodiment

Figure 8B:
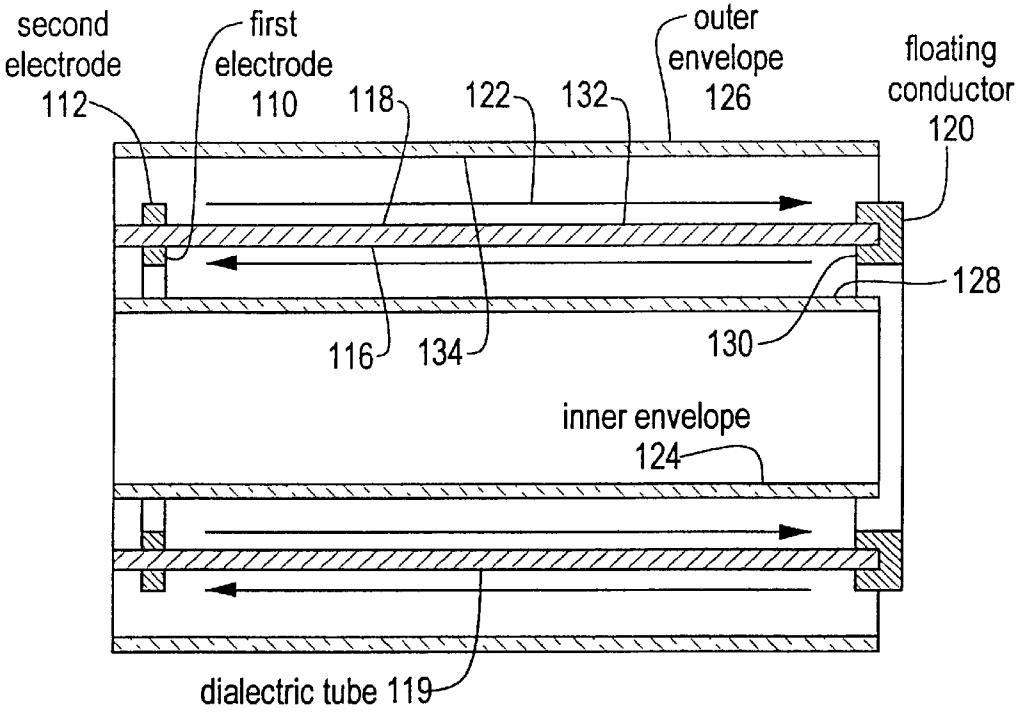
FIGS. 8A and 8B are an end view and a cross sectional side view, respectively, of a cylindrical surface discharge lamp.
Figure 8A:
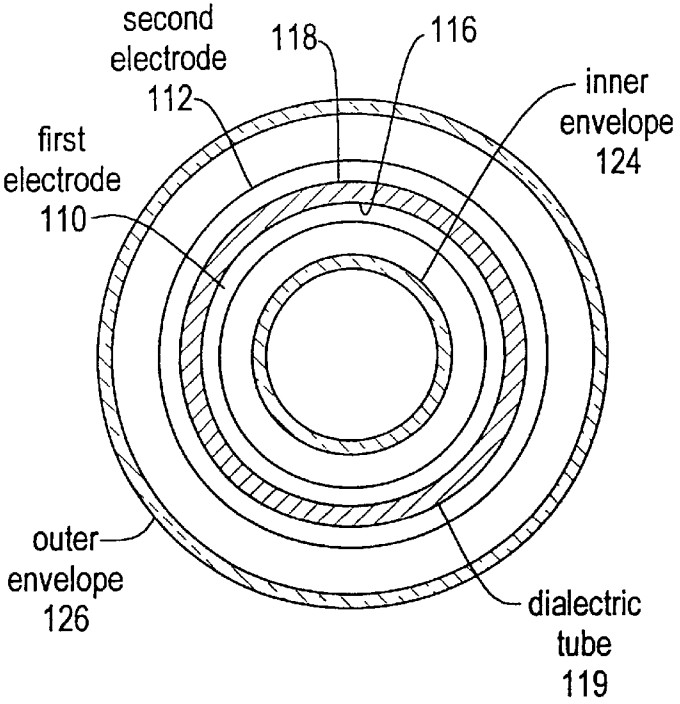

In a cylindrical structure, shown in FIGS. 8A and 8B, first 110 and second 112 electrodes are mounted on inner and outer surfaces 116 and 118, respectively, at one end of a dielectric tube 114. A floating conductor 120 is mounted at the other end of the tube to conduct a surface discharge 122 around the end of the tube between the inner and outer surfaces. For discharges in gas, inner transparent tube envelope 124 extends coaxially within dielectric tube 114 to retain discharge gas between the outer surface 128 of the transparent tube and the inner surface 130 of the dielectric tube and an outer transparent tube 126 retains discharge gas between the outer surface 132 of the dielectric tube and the inner surface 134 of the outer transparent tube. In one application, water to be treated flows through the inner transparent tube 124 and subsequently flows along the outside of the outer transparent tube 126. The discharge gas contained within the annular spaces formed between the inner and outer transparent tubes, 128 and 126, and dielectric tube 119 may be withdrawn and replaced during operation so that fresh discharge gas is used. A port for this purpose, although not shown, is understood. This gas flow prevents the deposition of discharge residue within the annular spaces. Also, the uses of trigger elements, as described above, are included.

Truncated Cone Embodiment

Figure 9A:
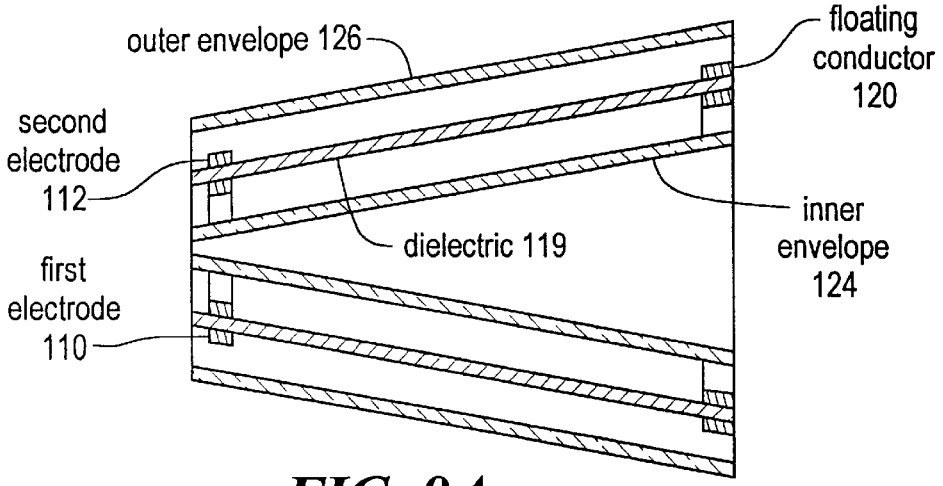
FIGS. 9A, 9B and 9C are a cross sectional side view and end views, respectively, of a truncated cone surface discharge lamp.
Figure 9B:
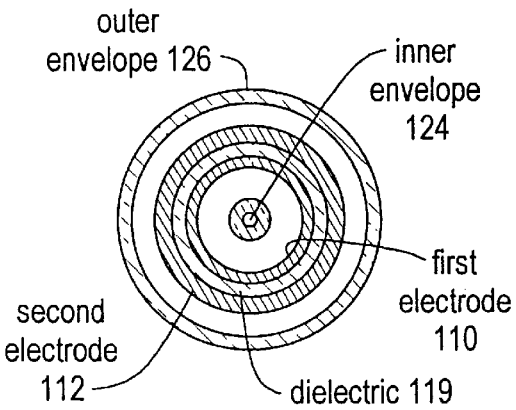
Figure 9C:
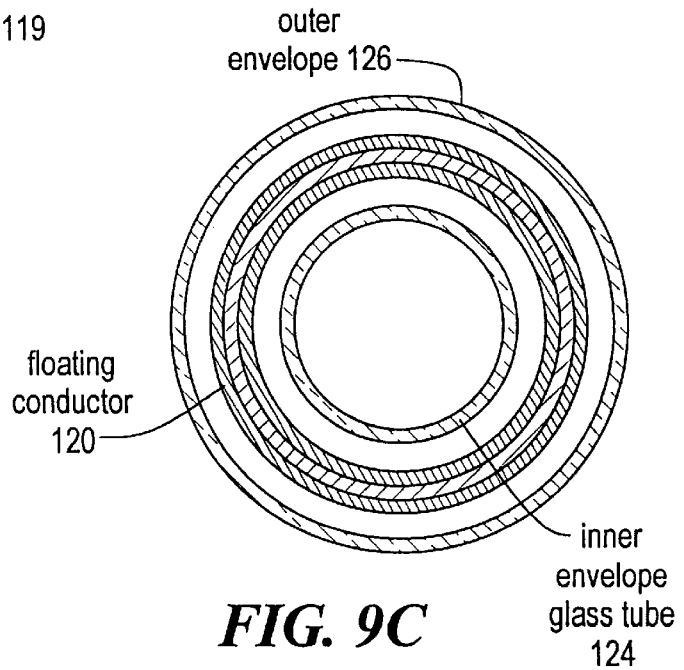

Shown in FIGS. 9A, 9B and 9C is a SD lamp in which the radiation source is in the shape of a truncated cone. In one application, contaminated water passes through the narrow end of the device where the light intensity is greatest and flows toward the larger diameter end where the light intensity is reduced, enabling efficient use of energy. Labeled elements correspond to those stated above in reference to FIGS. 8A and 8B.

Annular Embodiment

Figure 10A:
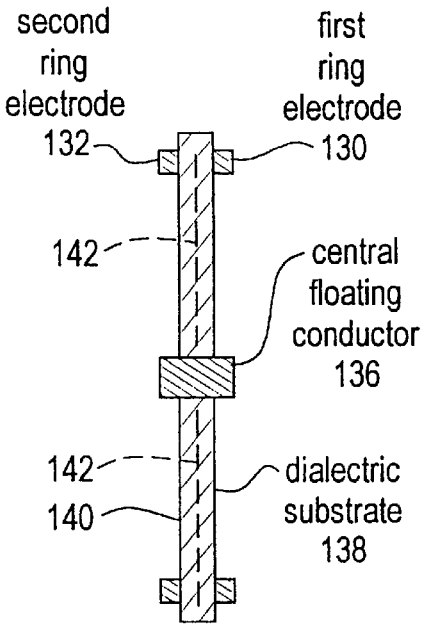
FIGS. 10A and 10B are a cross sectional side view and a top view, respectively, of an annular surface discharge lamp.
Figure 10B:
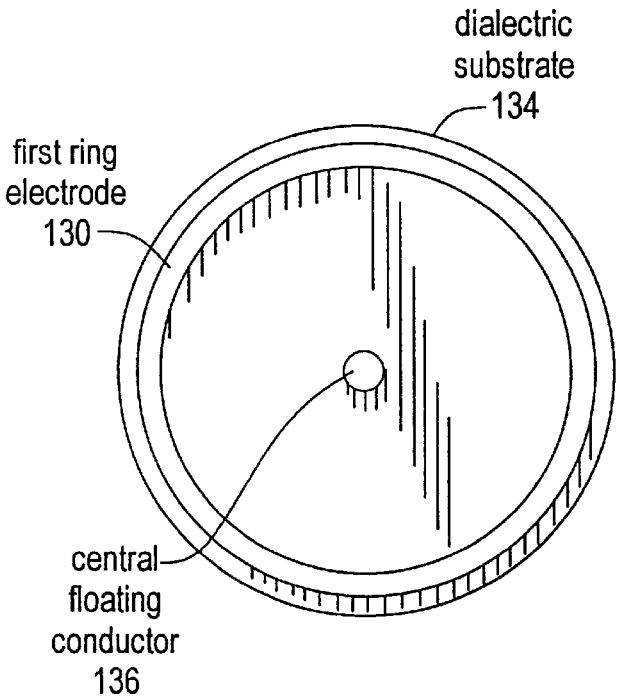

In the annular arrangement shown in FIGS. 10A and 10B, two spaced apart ring electrodes, 130 and 132, encircle opposite sides of a planar dielectric disk 134 and a central floating conductor 136 extends through the disk. Surface discharges are generated on both sides, 138 and 140, of the disk between the two ring electrodes and the central conductor. Trigger elements 142 are disposed within the thickness of the dielectric disc to capacitively guide surface discharges along the surfaces of the disk.

Alternatively, the first and second electrodes can be coupled together to provide a discharge path between the two sides of the dielectric disk, and the central conductor can be made into two electrodes disposed on opposite sides of the disk and spaced apart by the dielectric material of the disk.

This invention is intended to include situations in which the discharge medium is a liquid. In such situations the sound emission is much increased and the SD lamp may be used as a sound, light or combined light and sound source. In liquids the electric discharge also produces chemical reactions that, when combined with the sound and light, are particularly effective.

The trigger elements mentioned above are of wire form or they may be in the form of conductive meshes or conductive plates.

Also, additional sandwich geometries, including spherical, hemispherical, curved, and the like, are understood to be included in the invention.

What is claimed is:

1. A high intensity discharge lamp comprising a dielectric substrate, a first electrode near said dielectric substrate, a second electrode spaced from first electrode and near said dielectric substrate, a conductor spaced from said dielectric substrate, and adapted to provide a current return from one of said electrodes to an electrical driver circuit, the lamp constructed to enable the presence of a medium between said first and second electrodes, at least one metal element near said dielectric substrate, the lamp and metal element constructed and arranged to enable a coolant to flow adjacent to at least one surface of said dielectric substrate to transfer heat from said dielectric substrate to said coolant, said electrical driver circuit constructed to produce an electric potential sufficient to cause an electrical breakdown of the medium so that a discharge is produced.

2. The high intensity discharge lamp of claim 1 including at least one transparent envelope spaced from said dielectric substrate.

3. The high intensity discharge lamp of claim 1 wherein said metal element is wire mesh.

4. The high intensity discharge lamp of claim 1 wherein said metal element is wire coil.

5. The high intensity discharge lamp of claim 1 including a reflective surface adjacent to at least one surface of said dielectric substrate, said reflective surface adapted to provide directionality to radiation emitted from said discharge.

6. The high intensity discharge lamp of claim 1 wherein said dielectric substrate includes material comprising at least silicon.

7. The high intensity discharge lamp of claim 2 wherein said discharge along said dielectric surface occurs at a specified distance from said transparent envelope to maintain a high emission of UV light.

8. The high intensity discharge lamp of claim 1 wherein said metal element is a trigger element connected to a trigger circuit, said trigger circuit constructed to produce an electric potential between the trigger element and one of said electrodes to cause the electrical breakdown of the medium, initiated by the trigger element so that said discharge is produced.

9. The high intensity discharge lamp of claim 8 including a multiplicity of trigger elements.

10. The high intensity discharge lamp of claim 9 wherein said trigger elements are configured to guide said discharge along the length of said dielectric substrate.

11. The high intensity discharge lamp of claim 1 wherein said lamp is adapted to produce a multiplicity of discharges at a specified production rate.

12. The high intensity discharge lamp of claim 11 wherein said production rate is of at least about 1 Khz.

13. The high intensity discharge lamp of claim 11 wherein said electrical driver circuit comprises an igniter switch to enable said lamp to operate at a low voltage.

14. The high intensity discharge lamp of claim 1 wherein said dielectric substrate has a generally hemispherical shape defining a convex surface and a concave surface.

15. The high intensity discharge lamp of claim 14 wherein said discharge occurs over the convex surface of said dielectric substrate and said coolant is enabled to flow over the concave surface of said dielectric substrate.

16. The high intensity discharge lamp of claim 14 wherein said discharge occurs over the concave surface of said dielectric substrate and said coolant is enabled to flow over the convex surface of said dielectric substrate.

17. The high intensity discharge lamp of claim 1 wherein said dielectric substrate is configured as a sandwich structure so that said discharge is produced simultaneously on opposite sides of said dielectric substrate.

18. The high intensity discharge lamp of claim 17 wherein said sandwich structure has a substantially planar shape.

19. The high intensity discharge lamp of claim 18 including coolant channels disposed between opposite sides of said sandwich structure, said coolant enabled to flow through said coolant channels.

20. The high intensity discharge lamp of claim 17 wherein said sandwich structure has a substantially cylindrical shape.

21. The high intensity discharge lamp of claim 17 wherein said sandwich structure has a substantially truncated cone shape.

22. The high intensity discharge lamp of claim 17 wherein said sandwich structure has an annular shape.

23. A high intensity discharge lamp comprising a dielectric substrate, a first electrode near said dielectric substrate, a second electrode spaced from first electrode and near said dielectric substrate, a conductor adapted to provide a current return from one of said electrodes to an electrical driver circuit, and at least one transparent envelope spaced from said dielectric substrate, the lamp constructed to enable the presence of a medium between said first and second electrodes, said electrical driver circuit constructed to produce an electric potential sufficient to cause an electrical breakdown of the medium so that a discharge is produced, said discharge occurring at a specified distance from said transparent envelope to maintain a high emission of UV light.

24. A high intensity discharge lamp comprising a dielectric substrate having a substantially hemispherical shape defining a convex surface and a concave surface, a first electrode near said dielectric substrate, a second electrode spaced from first electrode and near said dielectric substrate, and a conductor adapted to provide a current return from one of said electrodes to an electrical driver circuit, the lamp constructed to enable the presence of a medium between said first and second electrodes, said electrical driver circuit constructed to produce an electric potential sufficient to cause an electrical breakdown of the medium so that a discharge is produced over one of said convex or said concave surfaces.

25. A high intensity discharge lamp comprising a dielectric substrate having a sandwich structure defining opposed broad sides, a first electrode near said dielectric substrate, a second electrode spaced from first electrode and near said dielectric substrate, and a conductor adapted to provide a current return from one of said electrodes to an electrical driver circuit, the lamp constructed to enable the presence of a medium between said first and second electrodes, said electrical driver circuit constructed to produce an electric potential sufficient to cause an electrical breakdown of the medium so that a discharge is produced simultaneously over said opposed broad sides.

26. A method to produce a high intensity emission of radiation, the method comprising:

creating an electrical discharge over a dielectric substrate, and cooling said dielectric substrate by directing coolant flow such that the coolant flow is in direct contact with at least one surface of said dielectric substrate.

* * * * *